US008790037B2

(12) United States Patent
Culleton et al.

(10) Patent No.: US 8,790,037 B2
(45) Date of Patent: Jul. 29, 2014

(54) SURFACES USING STRUCTURAL MODULES

(75) Inventors: Paul David Culleton, Warrington (GB); Andrew Bryan Shuttleworth, Poulton-le-Fylde (GB); Carolus Hermanus Van Raam, Hoogmade (NL)

(73) Assignee: Permavoid Limited (GB)

( * ) Notice: Subject to any disclaimer, the term of this patent is extended or adjusted under 35 U.S.C. 154(b) by 0 days.

(21) Appl. No.: 13/383,830

(22) PCT Filed: Jul. 13, 2010

(86) PCT No.: PCT/GB2010/001332
§ 371 (c)(1),
(2), (4) Date: Mar. 14, 2012

(87) PCT Pub. No.: WO2011/007128
PCT Pub. Date: Jan. 20, 2011

(65) Prior Publication Data

US 2012/0163911 A1 Jun. 28, 2012

(30) Foreign Application Priority Data

Jul. 13, 2009 (GB) ..... 0912174.0

(51) Int. Cl.
*E01C 3/06* (2006.01)
*E01C 3/00* (2006.01)

(52) U.S. Cl.
CPC .. *E01C 3/006* (2013.01); *E01C 3/06* (2013.01)
USPC ..... 404/29; 404/34; 404/41

(58) Field of Classification Search
CPC ..... E01C 3/006; E01C 3/06
USPC ..... 404/18, 27–29, 34, 41, 45
See application file for complete search history.

(56) References Cited

U.S. PATENT DOCUMENTS 5,437,698 A 8/1995 Furukawa
6,736,569 B2 * 5/2004 Lee ..... 405/50

(Continued)

FOREIGN PATENT DOCUMENTS

AU 620283 2/1992

(Continued)

OTHER PUBLICATIONS

PCT International Search Report, PCT International Application No. PCT/GB2010/001332 dated Nov. 5, 2010.

(Continued)

*Primary Examiner* — Raymond W Addie
(74) *Attorney, Agent, or Firm* — McDonnell Boehnen Hulbert & Berghoff LLP.

(57) ABSTRACT

A structural module which is suitable for combining with like structural modules to form an area suitable for walking on and/or for travelling directly over by a vehicle, comprises a flat top wall and a bottom wall spaced therefrom by side walls so as to define a volume between the top and bottom walls. The top wall is provided with a plurality of apertures to permit the flow of liquid into the volume, and the side walls and/or the bottom wall are provided with apertures to permit the flow of liquid out of the volume. The size and shape of each aperture in the top wall is such that the maximum diameter of sphere that the aperture would let through is in a range up to 10 mm.

24 Claims, 9 Drawing Sheets

(56) References Cited

U.S. PATENT DOCUMENTS

| | | | | |
|---|---|---|---|---|
| 6,908,256 | B1 | 6/2005 | Humphries et al. | |
| 7,220,076 | B2 * | 5/2007 | Boll | 404/6 |
| 7,249,912 | B2 * | 7/2007 | Reese | 404/36 |
| 7,704,011 | B2 * | 4/2010 | Marshall | 404/29 |
| 2002/0078652 | A1 | 6/2002 | Hawkes | |
| 2003/0188505 | A1 * | 10/2003 | Marshall | 52/606 |
| 2005/0224690 | A1 * | 10/2005 | Hobbs | 249/2 |
| 2007/0274776 | A1 | 11/2007 | Urriola | |

FOREIGN PATENT DOCUMENTS

| | | | |
|---|---|---|---|
| DE | 3921496 | A1 | 1/1991 |
| EP | 1469133 | A2 | 10/2004 |
| GB | 2395135 | A | 5/2004 |
| WO | WO2008/009879 | A1 | 1/2008 |
| WO | WO2009/030896 | A1 | 3/2009 |

OTHER PUBLICATIONS

Great Britain Search Report, Great Britain Application No. GB0912174.0 dated Feb. 18, 2010.

Great Britain Search Report, Great Britain Application No. GB0912174.0 dated Sep. 24, 2009.

* cited by examiner

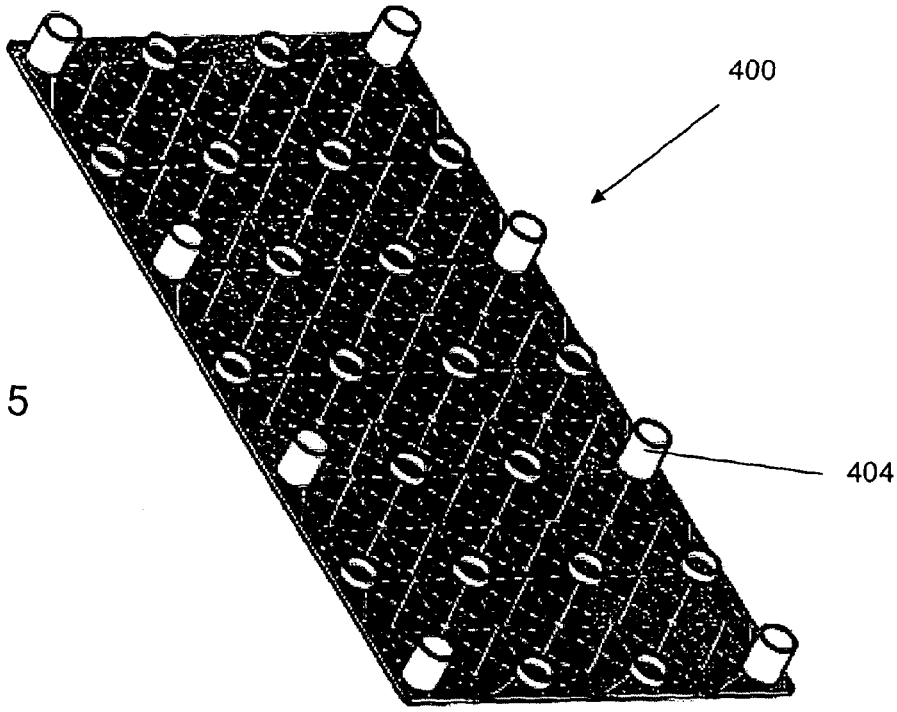
FIG. 15
FIG. 16
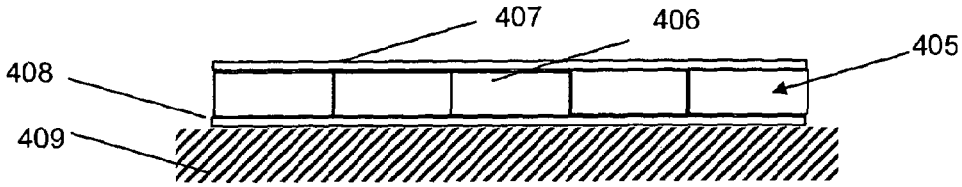

SURFACES USING STRUCTURAL MODULES

CROSS REFERENCE TO RELATED APPLICATIONS

The present application is a national stage entry of PCT/GB2010/001332, filed Jul. 13, 2010, and claims priority to GB 0912174.0, filed Jul. 13, 2009. The full disclosures of GB 0912174.0 and PCT/GB2010/001332 are incorporated herein by reference.

This invention relates to structures for forming surfaces for areas suitable for walking on. In particular, the invention relates to structural modules for forming such a surface.

In the field of construction generally, it is known from WO 02/14608 to form a sub-surface layer from a structural module instead of traditional particulate materials such as natural aggregate or sand. Such a module has apertures in its upper and lower walls, and in its side walls, which are used for drainage purposes, for example.

It has now been appreciated that the known modules may be modified so that they are suitable for an alternative purpose, namely to provide a surface which a person can walk on and/or a vehicle may travel directly upon.

Thus, viewed from one aspect, the invention provides a structural module suitable for combining with like structural modules to form an area suitable for walking on and/or for travelling directly over by a vehicle, wherein the structural module comprises a flat top wall and a bottom wall spaced therefrom by side walls so as to define a volume between the top and bottom walls, the top wall being provided with a plurality of apertures to permit the flow of liquid into the volume, and the side walls and/or the bottom wall being provided with apertures to permit the flow of liquid out of the volume, wherein the size and shape of each aperture in the top wall is such that the maximum diameter of sphere that the aperture would let through is in a range up to about 10 mm.

It will be expressed that the use of the word "sphere" does not imply that the module will be used in an environment where the module would be exposed to spheres of any type. It simply sets out a test for determining whether an aperture has the required properties, and the same test could be carried out with other objects having a circular profile, such as a cylinder. In practice, the apertures themselves need not be circular at all (and in some preferred embodiments the majority or substantially all are not circular). The apertures could be triangular, rectangular, hexagonal and so forth.

In some embodiments of the invention, the size and shape of each aperture in the top wall is such that the maximum diameter of sphere that the aperture would let through is about 9 mm; in some embodiments of the invention, the size and shape of each aperture in the top wall is such that the maximum diameter of sphere that the aperture would let through is about 8 mm; in some embodiments of the invention, the size and shape of each aperture in the top wall is such that the maximum diameter of sphere that the aperture would let through is about 7 mm; in some embodiments of the invention, the size and shape of each aperture in the top wall is such that the maximum diameter of sphere that the aperture would let through is about 6 mm; in some embodiments of the invention, the size and shape of each aperture in the top wall is such that the maximum diameter of sphere that the aperture would let through is about 5 mm.

In some embodiments of the invention, the arrangement is such that the maximum diameter of sphere that the apertures in the top wall would let through is a specified value in a range of from about 5 mm to about 10 mm. The specified value could for example be about any one of the values in the range of 5 mm to 10 mm, in 0.5 mm or other increments, such as 5, 5.5, 6, 6.5, 7, 7.5, 8, 8.5, 9, 9.5 and 10 mm, or 5, 5.1, 5.2 . . . 9.9, 10 mm.

In use, an array of such modules will form a surface. Optionally, a flexible layer such as a carpet can be laid on this surface without the need for an intervening rigid layer, for example of wooden sheets or planks. The size and shapes of the apertures in the top wall of the module are such that there will be limited variations in the flatness of the flexible layer. With larger apertures there would be indentations apparent, in the regions of the apertures. Not only are these unsightly, but they can present a hazard and cause people to trip. In the case of a person wearing a high heel with a base of relatively small cross section, it is important that the aperture size is sufficiently small to prevent the heel passing through wholly or partly.

If the module is to be used in a situation where high heels may be encountered, preferably the aperture size and shape is such that the aperture would not let through a sphere which has a diameter of greater than about 7 mm. It might be that the aperture should be smaller than that and such that the aperture would not let through a sphere which has a diameter of greater than about 6 mm; or such that the aperture would not let through a sphere which has a diameter of greater than about 5 mm.

There will be circumstances where an array of the modules can be used to form a surface without a covering flexible layer, for example to provide a walkway in a muddy site. The maximum permissible size of the apertures in the top wall may depend on the intended use. If the environment is a building site or somewhere else where people are likely to use boots, the apertures can be towards the upper end of the permissible size range. If the environment is one where people might wear high heels, the apertures would need to be towards the lower end of the permissible size range.

The invention also extends to an array of modules as described above, connected to form a surface. Thus, viewed from another aspect, the invention provides an array of interconnected structural modules which forms an area suitable for walking on and/or for travelling directly over by a vehicle, wherein each structural module comprises a flat top wall and a bottom wall spaced therefrom by side walls so as to define a volume between the top and bottom walls, the top wall being provided with a plurality of apertures to permit the flow of liquid into the volume, and the side walls and/or the bottom wall being provided with apertures to permit the flow of liquid out of the volume, wherein the size and shape of each aperture in the top wall is such that the maximum diameter of sphere that the aperture would let through is in a range up to about 10 mm.

The invention also extends to a method of providing a surface by interconnecting in an array a plurality of modules as described above. Thus, viewed from another aspect, the invention provides a method of providing a surface suitable for walking on and/or for travelling directly over by a vehicle by interconnecting in an array a plurality of structural modules, wherein each structural module comprises a flat top wall and a bottom wall spaced therefrom by side walls so as to define a volume between the top and bottom walls, the top wall being provided with a plurality of apertures to permit the flow of liquid into the volume, and the side walls and/or the bottom wall being provided with apertures to permit the flow of liquid out of the volume, wherein the size and shape of each aperture in the top wall is such that the maximum diameter of sphere that the aperture would let through is in a range up to about 10 mm.

Another aspect of the invention concerns arrangements in which a flexible layer is provided over the array of modules.

Thus, viewed from another aspect, the invention provides an array of interconnected structural modules which forms an area suitable for walking on and/or for travelling directly over by a vehicle, wherein each structural module comprises a flat top wall and a bottom wall spaced therefrom by side walls so as to define a volume between the top and bottom walls, the top wall being provided with a plurality of apertures to permit the flow of liquid into the volume, and the side walls and/or the bottom wall being provided with apertures to permit the flow of liquid out of the volume, wherein a flexible surface layer on which a person is to walk is provided over the top walls of the modules without an intervening rigid layer, and wherein the size and shape of each aperture in the top wall is such that there is substantially no variation in the flatness of the flexible surface layer.

Viewed from another aspect, the invention provides a method of providing a surface suitable for walking on and/or for travelling directly over by a vehicle by interconnecting in an array a plurality of structural modules, wherein each structural module comprises a flat top wall and a bottom wall spaced therefrom by side walls so as to define a volume between the top and bottom walls, the top wall being provided with a plurality of apertures to permit the flow of liquid into the volume, and the side walls and/or the bottom wall being provided with apertures to permit the flow of liquid out of the volume, wherein a flexible surface layer on which a person is to walk is provided over the top walls of the modules without an intervening rigid layer, and wherein the size and shape of each aperture in the top wall is such that there is substantially no variation in the flatness of the flexible surface layer.

The structural modules used to form the array may be as defined in respect of preceding aspects of the invention, for example with the size and shape of each aperture in the top wall of each module being such that the maximum diameter of sphere that the aperture would let through is in a range up to about 10 mm.

A preferred module for use in accordance with the various aspects of the invention is cuboid in form, and may, for example, be moulded from a suitably strong plastics material. In some embodiments each module is formed from a top part which includes the top wall and the upper parts of the sidewalls, and a bottom part defining the bottom wall and the lower parts of the sidewalls.

The top and bottom parts may each be provided with a set of part-pillars extending towards one another, the two sets of part-pillars co-operating with one another to form pillars extending between the top and bottom walls to resist vertical and lateral crushing of the module. The top and bottom parts may be two plastics moulded components which are fitted one inverted on top of the other.

Preferably, the module further comprises a network of bracing members extending between the pillars within the module and/or the side walls to resist deformation of the module in a horizontal plane. In the preferred arrangement the walls and network have apertures formed therein to allow water to flow both vertically downwards and horizontally through the module, for drainage purposes.

As the module has apertures in its upper wall, water can drain into the structural module below, for example if the surface is to be used externally and there is rain, and/or if there are spillages of liquids as might be encountered in certain environments, thereby preventing the upper side of the surface from becoming excessively wet.

Furthermore, as the size and shape of the apertures is preferably such that they would cause substantially no variation in the flatness of a flexible surface layer placed over the module, the module can provide a surface that is easy to walk over and that relatively small objects would not catch in.

In order to provide an area formed from the structural module, it may be possible to simply lay the structural module directly on the ground. The module can be particularly useful as a temporary surface but it may also be used as a permanent surface.

The structural module may be relatively lightweight and therefore would exert only a relatively small force on the ground beneath compared to heavier alternatives. This is beneficial because the land beneath is therefore less likely to move under the weight of the surface. It also means that if the land beneath contains any impurities or contaminants, these are less likely to be "squeezed" out into the surrounding earth or the surface above.

Furthermore, due to the reduction in weight, the present invention can involve significantly less transportation costs than some alternative surfaces.

In use, the top wall of the structural module will normally define a plane which is substantially flat and horizontal, and an array of modules will have their top surfaces co-planar, i.e. their top walls will lie in a common horizontal plane, or in the case of an inclined surface a common inclined plane. However, gentle curvatures or slopes can be accommodate in accordance with the underlying profile.

A top wall with apertures of such sizes and shapes as described above can ensure that relatively small objects cannot fit through the apertures and ensure that the module is easy to walk on.

The structural module should preferably be sufficiently strong that it can support any anticipated loads (e.g. from people, vehicles, equipment) without breakage. In addition, the modules should ideally be stiff enough that they do not deform too easily under weight.

However, in some cases the structural module may be allowed to deform slightly under a load and thereby provide a slight cushioning effect.

Preferably, the apertures in the top wall are formed by a mesh-like structure of connected members. The members may have varying thicknesses, i.e. some may be thicker than others in order to provide additional strength.

Apertures in the top, side and bottom walls may be of any shape.

The aperture to total area ratio of the top wall may be at least 40%, 50%, 55%, 60%, 65%; 70%, 75%, 80%, 85% or 95%. Such relatively high ratios ensure that water can pass quickly and easily from an upper synthetic surface layer, if provided, into the structural module below. Preferably, the aperture to total area ratio of the top wall is at least 60%. Preferably there are apertures distributed over the whole of the top wall, although there could be some arrangements in which there are regions of the top wall that are free from apertures.

The bottom wall of the module may also have at least one aperture to permit the flow of liquid therethrough. However, it is not necessary that the size and shape of this aperture be limited in the same way as the apertures in the top wall. The aperture or apertures in the bottom wall of the module can allow water in the module to drain out of the module into the ground or sub-surface layers below.

Preferably, any apertures in the bottom wall are larger, preferably substantially larger, than those in the top wall in order to allow water to pass through more easily. For example, a sphere with a diameter which exceeds the maximum diameter allowable for spheres to be able to pass through an aperture in the top wall, may be able to pass through an aperture in the bottom wall.

The side walls of the module may have at least one aperture to permit the flow of liquid therethrough. As with any apertures in the bottom wall, it is not necessary that the size and shape of any apertures in the side wall or walls be limited in the same way as the apertures in the top wall. Apertures in side walls can allow water to pass laterally through the surface.

Preferably, any apertures in the side wall are larger, preferably substantially larger, than those in the top wall in order to allow water to pass through more easily. For example, a sphere with a diameter which exceeds the maximum diameter allowable for spheres to be able to pass through an aperture in the top wall, may be able to pass through an aperture in the side wall.

Accordingly, in preferred embodiments at least some of the apertures in the side walls and/or the bottom wall are such that they would let through a sphere with a diameter of greater than the specified maximum diameter for a sphere to pass through an aperture in the top wall.

It is possible that more than one layer of structural modules could be provided. If so, any apertures in the top walls of modules not in the top layer would not have to meet the size and shape requirements of those in the top layer, although for practical reasons it may be simpler to manufacture them to the same design as modules in the top layer.

Where a plurality of modules are provided, any apertures in a side wall or side walls of the modules may allow water to pass laterally from module to module. They may also permit the passage of services, such as electrical cables, telephone or other communications cables, water pipes, waste pipes, heating pipes, heated or cooled air, and so forth.

Preferably the components of the area are non bio-degradable in order to ensure longevity.

The modules may be connected to other structural modules, for example by interlocking means provided on the sides of the structural modules, such as the means described in WO 02/14608.

The structural module may have a high water storage to volume ratio (e.g. 80%) and should be strong enough to support any surface or traffic (e.g. human, animal or vehicle) above. The structural modules could be made of a suitable plastic, for example. In a preferred embodiment the modules are made from recycled plastic.

It is preferred that the structural module is of generally cuboid form so that it can tessellate with other modules. The top and bottom walls may be generally parallel. Opposite side walls may also be parallel.

One or more of the structural modules may contain a porous block for holding water. The porous block could be made of foamed polymeric material, for example. Such an arrangement is disclosed in WO 2009/030896, in respect of which there are inventors in common with those of the present invention.

In general, a structural module may be have a depth of about 60 mm, about 70 mm, about 80 mm, about 90 mm, about 100 mm, about 110 mm, about 120 mm, about 130 mm, about 140 mm, about 150 mm, about 175 mm, about 200 mm, about 225 mm, about 250 mm, about 275 mm, about 300 mm, about 325 mm, about 350 mm, or be within any range whose lower limit is defined by one of those values and whose upper limit is defined by another of those values. Preferably the length and breadth dimensions of the structural module are both greater than the depth. A typical structural module in a preferred embodiment might have a length of between about 700 mm to about 720 mm, for example being about 710 mm; a breadth of from about 350 mm to about 360 mm, for example being about 355 mm; and a depth in the ranges set out above, for example being about 60 mm, about 120 mm or about 240 mm.

As regards the structure of the structural modules, preferably these are formed of moulded plastics material. In a preferred arrangement, each structural module is formed from a top half which includes a top wall and the upper part of a peripheral sidewall, and a bottom half defining a bottom wall and the lower part of the peripheral sidewall. The top and bottom halves may be fitted one inverted on top of the other. The top and bottom halves may each be provided with a set of half-pillars extending towards one another, the two sets of half-pillars co-operating with one another to form pillars extending between the top and bottom walls to resist vertical crushing of the structural module. The halves may be two similar integral plastics moulded components.

In an alternative module, the module is formed of a base part and a lid, where the base part provides the bottom wall and side walls, and the lid forms the top wall. The lid may be fitted on top of the base part. The base part may be provided with a set of pillars extending upwards to the lid, the pillars extending between the lid and the bottom wall to resist vertical crushing of the structural module. The lid may have extending members arranged to fit into receiving portions on the base part and thereby prevent lateral movement of the lid over the base part, once they are fitted together. Thus in some embodiments, there is a lower portion which provides the bottom wall and the side walls, and an upper portion in the form of a lid which is attached to the lower portion and provides the flat top wall.

The base part and the lid may be moulded plastics components.

Preferably, the structural module further comprises a network of bracing members extending between the pillars within the structural module and/or the side walls to resist deformation of the structural module in a horizontal plane. The walls and network may have one or more apertures formed therein to allow fluid flow both vertically and horizontally through the structural module.

It will be appreciated that the peripheral wall both separates and supports the top and bottom walls.

Although in the preferred embodiment the structural module is formed of plastics, it could be made of any other type of material that could support the loads expected in a particular environment, such as concrete, metal, wood, composite materials and so forth.

In use, a flexible surface layer could be a carpet, a fabric (e.g. felt) or any other suitable material which provides a surface to walk on. Ideally, the upper surface layer should be water-permeable, to take advantage of the features of the modules which provide good drainage.

A geotextile or other layer may be provided below the structural modules. This geotextile layer could be water-permeable or impermeable, depending on the drainage requirements. The geotextile or other layer may provide a treatment layer for removal of contaminants such as hydrocarbons from the surface water.

An aggregate bedding layer may be provided beneath the structural modules. This aggregate layer can support the structural module and ideally also any associated load without significant movement. In addition, an aggregate layer can provide good drainage capabilities from the structural module. The aggregate layer can act as a levelling layer between an irregular formation beneath and the geotextile or similar layer and/or structural module above.

A geotextile or similar layer may be provided beneath the aggregate layer. This can prevent any silts and/or impurities in the earth beneath from passing up into the other layers of the surface, whilst allowing water to drain out from the surface into the earth beneath. The geotextile or similar layer may also be used to reinforce the formation and provide added strength to the surface. The geotextile or similar layer may also provide a treatment layer for removal of contaminants from the surface water such as hydrocarbons.

A drainage layer may be provided beneath the structural module. If geotextile and/or aggregate layers are provided, then the drainage layer may be provided beneath these layers. The drainage layer can allow water to drain out of the layers into the ground beneath or into pipes through which the water can be transported out of the area. The drainage layer could be, formed of particulate matter such as gravel and/or stones. The drainage layer could comprise a conduit or perforated pipe to allow the water to flow out of the area and/or to pass up into the module from beneath where the module is being used as part of a water management system for temporary attenuation of water, for example.

An impermeable membrane could be provided beneath the drainage layer. This would prevent water from passing into the ground beneath.

Alternatively, a water-permeable membrane may be provided beneath the drainage layer. This would allow water to pass out of the drainage layer into the ground beneath. The water-permeable membrane could contain or be formed from geotextile material, for example.

The geotextile layers that may be provided in the present invention could be made of geotextile fleece material and/or could comprise hydrophilic fibres.

In some locations, a water source may contain water-borne diseases such as cholera or legionella. An additive may be included in the material forming the structural modules, for example, which kills such diseases. Alternatively, or in addition, the additive could be added to other parts of the area such as a covering layer, geotextile layer and so forth.

It will be appreciated that the structural module of the present invention could have many uses such as providing a temporary surface for an event. It could also be used outside a dwelling or building as an area suitable for parking vehicles on and walking over, whilst still allowing water to drain into the ground beneath. This may be particularly beneficial in areas where it is undesirable, for drainage reasons, to place concrete or macadam over an area of ground. For example, in built-up areas where there are already a lot of concrete or macadam surfaces that prevent drainage of surface water into the ground beneath, a firm surface which allows cars to park on it and people to walk on it without becoming waterlogged could be very desirable.

An area formed of structural modules according to the present invention may be assembled at the location of use or, alternatively, if an upper surface layer, or one or more geotextile layers is desired, a unit may be provided comprising a structural module as described above with such additional layers as desired already in place, for example by attachment to the module. The unit could be connectable to another unit with interlocking means.

Accordingly, an area could be built to a desired size comprising a number of such units. The units may be prefabricated at a factory or workshop, for example, and then transported to the site of the area, where the units are joined together by the interlocking means to form an area of a desired size.

Such an area may be permanent or temporary. If an area is temporary (for example for a day, a week, a month or any other period of time), the units can easily be disconnected from each other and removed from the site. The units may also then be reused at a further site to form another area, if desired.

The units could be of various sizes, but typically by way of example they could measure 1.4 m (length)×0.7 m (width)× 0.1 m (depth).

The units may be relatively lightweight and could have a mass of around 10 kg, for example. This light mass allows the units to be easily lifted, handled, transported and installed, without specialist tools or equipment being required.

It is not necessary to excavate an area before installation of the units. Subsequent importation of a granular sub-base and/or a natural or artificial surfacing is also not required as the units themselves can provide sufficient components to form a suitable surface.

The size of the units may be such that they may fit through a standard door opening, for example through a standard doorway or gate at the side of a house and a thus an area may be constructed without the need for construction equipment that would not ordinarily fit through a doorway or gate A further benefit of the present invention is its ability to meet industry sustainable drainage aims of providing source control drainage. Source control drainage guidance promotes the use of pervious paving to manage rainwater where it lands by allowing the water to penetrate through the upper surfacing into a sub-base layer that is capable of providing temporary storage of a storm event within it. An example of such guidance is The Town and Country Planning (General Permitted Development) (Amendment) (No. 2) (England) Order 2008 No. 2362, which prevents the changing of a water-pervious external area (e.g. a natural grass surface within the cartilage of a dwelling house) to an impervious surface that may be subsequently used, for example, as a car parking area. The present invention can provide a modular, pervious surface, trafficable by vehicles that is prefabricated and can be assembled easily without need of excavation or formation of a sub-base.

Some embodiments of the invention will now be described by way of example only and with reference to the accompanying drawings in which:

FIG. 15 is a perspective view showing the underside of the lid shown in FIGS. 13 and 14; and FIG. 16 is a diagrammatic view of an array of modules forming a surface.

Referring now to FIGS. 1 to 12, a structural module is shown at 10 comprising a top wall 11, a bottom wall 12 and a peripheral wall 13 extending between the upper wall 11 and the bottom wall 12 to provide at least one side wall and in this example four side walls. The top wall 11, bottom wall 12 and peripheral wall 13 define a volume 14.

This module includes a porous block, as disclosed in WO 2009/030896. This structure is described below but it will be appreciated that the use of a block is optional in the context of the present invention.

Figure 2:
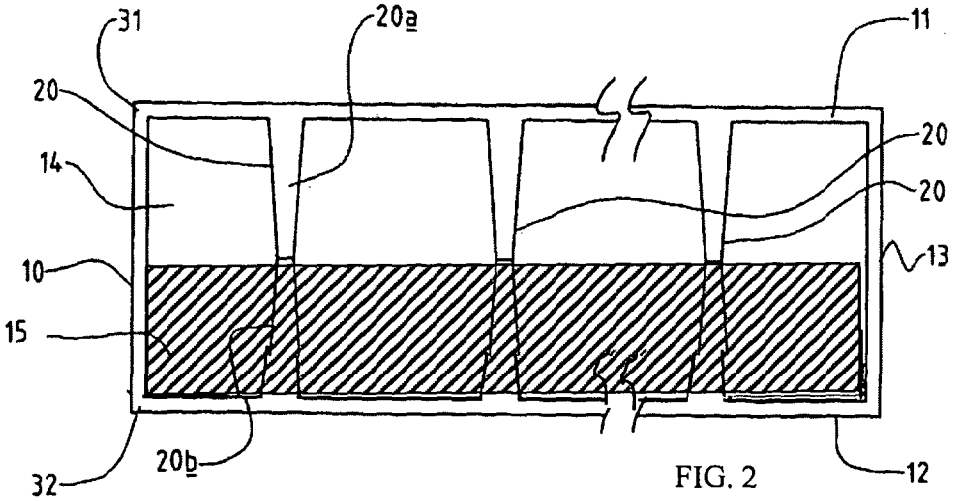
FIG. 2 is a section of FIG. 1.

In FIG. 2, located within the volume 14 is a porous rectangular block 15. The porous material in this case is a foamed phenol formaldehyde resin, such as that marketed by Smithers-Oasis under the trade mark OASIS™. The block 15 is fixed relative to the top wall 11, bottom wall 12 and peripheral wall 13 and in this case occupies the bottom part of the volume 14, extending upwards for approximately half of the height of the volume.

Figure 3:
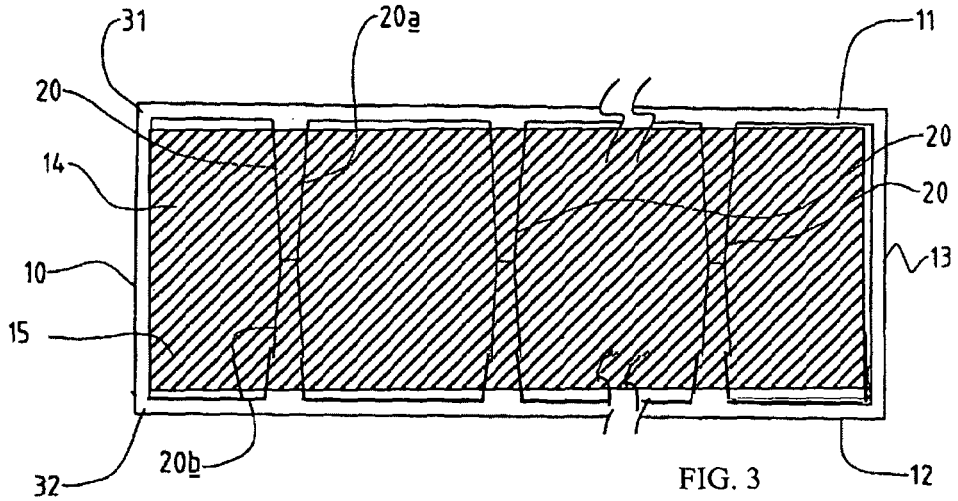
FIG. 3 is a section of FIG. 1, showing an alternative porous element.
Figure 4:
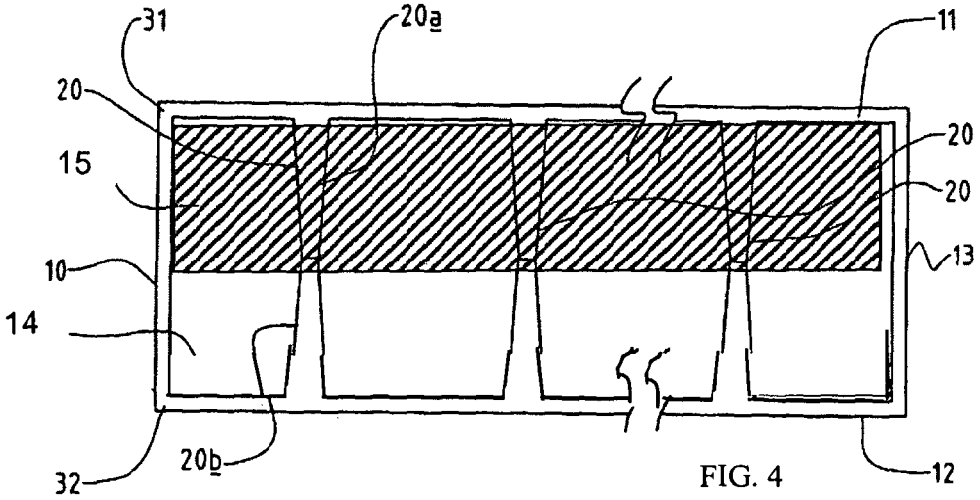
FIG. 4 is a section of FIG. 1, showing a further alternative porous element.

In FIG. 3 there is shown an alternative arrangement in which the block 15 occupies substantially all of the volume 14, and in FIG. 4 there is shown an alternative arrangement in which the block 15 occupies the top half of the volume 14.

Figure 1:
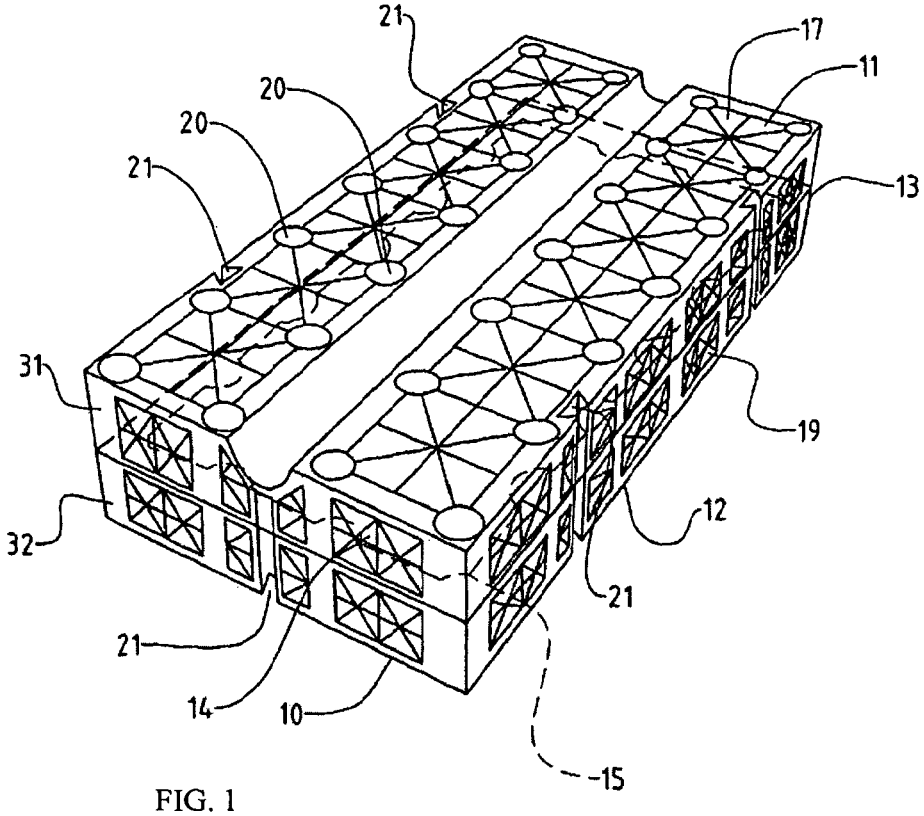
FIG. 1 is a perspective view of a structural module with a porous element.
Figure 6:
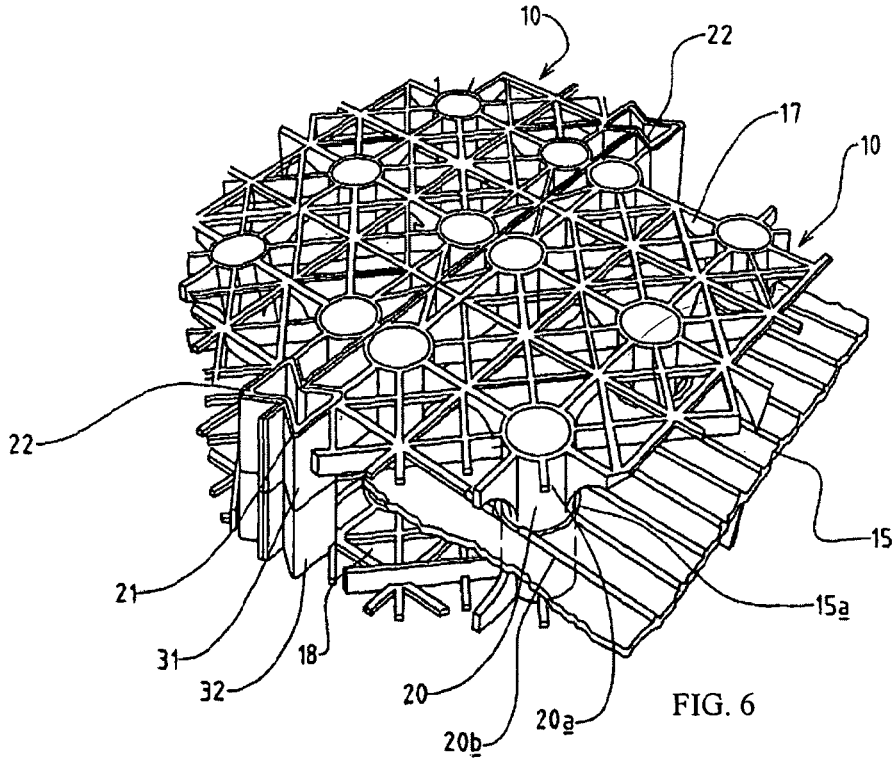
FIG. 6 is a broken away perspective view on a larger scale of part of two of the structural modules of FIG. 1 connected to one another.

As seen in FIGS. 1 and 6, the top wall 11, bottom wall 12 and peripheral wall 13 comprise a plurality of apertures 17, 18, 19 which, in this example, are generally triangular and are defined by a plurality of pillars forming the respective walls. The apertures 17, 18, 19 thus permit fluid to move in and out of the structural module 10.

In one embodiment, the size and shape of each aperture in the top wall of the module is such that a the maximum diameter of sphere that could fit through an aperture in the top wall is in a range up to about 10 to 15 mm. In one embodiment, the maximum diameter of sphere that could fit through an aperture in the top wall is about 5 mm; or in another embodiment about 6 mm; or in another, preferred, embodiment about 7 mm, or in another embodiment about 8 mm, or in another embodiment about 9 mm, or in another embodiment about 10 mm, or in another embodiment about 12 mm, or in another embodiment about 15 mm.

Internally, in this example, the structural module 10 comprises a plurality of pillars 20 extending between the top wall 11 and the bottom wall 12. In the present example, the pillars are generally cylindrical and hollow and are distributed in a grid arrangement across the length and width of the structural module 10. The pillars 20 are sufficiently strong to resist crushing of the structural module 10 and thus enable the structural module 10 to support a desired vertical or lateral load depending on the environment in which the structural module 10 will be used.

To allow a plurality of structural modules 10 to be rigidly connected together, the structural module 10 is provided with a plurality of keyways 21 located in the ends of the sides thereof. In this example, each keyway 21 is a groove of a generally female dovetail shape in plan view for slidably receiving a tie member 22. As seen in FIG. 6, the tie members 22 are of "bow tie" cross section, comprising a pair of trapezoids joined together along their short parallel sides to be received in the keyways 21 of adjacent structural modules 10 to hold them together. As will be apparent, the generally rectangular shape of the structural modules 10 enables a plurality of structural modules 10 to be connected together to form an extensive, substantially continuous layer of structural modules 10 of any desired area.

Each structural module 10 may be formed in two parts which are connected together to form the structural module 10, where a porous block 15 can be introduced into the structural module prior to connecting the two parts together, if a porous block is required. Alternatively, the two parts can be connected together to form the structural module 10 without any porous block 15 being contained therein.

With reference to FIGS. 1 and 6, the structural module 10 may comprise a top part 31 which defines the top wall and part of the peripheral side wall and a bottom part 32 defining the bottom wall and the lower part of the peripheral side wall. The top part 31 and the bottom part 32 are each provided with a set of half-pillars 20*a*, 20*b* whereby the two sets of half-pillars, 20*a*, 20*b* engage one another to form the pillars 20 extending between the top wall 11 and the bottom wall 12. Preferably, the top part 31 and the bottom part 32 comprise similar plastic moulded components. The structural module 10 may be formed by inverting one component and placing it on top of the other, and, if required, introducing the porous block 15 into the volume prior to joining the two parts.

In some cases one or more structural modules which are not filled with foam can be used.

Where foam is used, it need not be introduced as discussed above, but could be in the form of one or more blocks not shaped to the interior of the structural module, as loose material, or be injected as foam and cured in situ.

Figure 5:
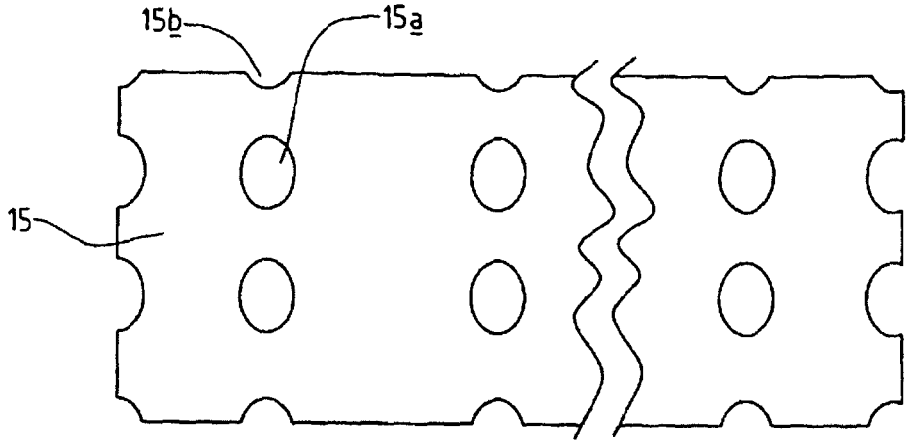
FIG. 5 is a plan view of the porous element of FIGS. 2, 3 and 4.

As seen in FIG. 5, since the structural module 10 is provided with pillars 20, the porous block 15 is provided with appropriate apertures 15*a* and/or cut outs 15*b* to receive the pillars 20. Such a configuration is advantageous in that the porous block 15 is constrained from substantial lateral movement by virtue of engagement of the pillars 20 in the apertures 15*a*, and is also constrained from vertical movement because the size of the apertures 15*a* is chosen so that there will be a reasonably tight fit with the pillars 20, thus locating the block firmly in the desired position in the structural module 10.

The structural module may have rigid top and bottom walls and rigid supporting elements, such as pillars or a sidewall, so that it can resist collapse under the loads to be encountered, which could for example include the weight of humans, animals, vehicles etc positioned or passing over the structural module A preferred structural module has a short term vertical compressive strength of at least about 500 kN/m$^2$, more preferably at least about 650 kN/m$^2$, and more preferably at least about 700 kN/m$^2$. The short term vertical deflection is preferably less than about 2 mm/126 kN/m$^2$, and more preferably less than about 1.5 mm/126 kN/m$^2$, in a preferred arrangement being about 1 mm/126 kN/m$^2$.

A structural module may be manufactured in a strong, rigid plastics material such as polypropylene copolymer.

The percentage of the volume of the structural module that is void space, ignoring the presence of a foam insert or the like, may be at least about 80%, at least about 85%, or at least about 90%. In one embodiment the void space is about 95%. For a structural module with top and bottom wails and a side wall enclosing a volume within the structural module, the percentage of surface area that is apertured is at least about 40%, at least about 45%, or at least about 50%. In an embodiment the percentage of surface area that is apertured is about 52%.

A structural module may have the following parameters:

Weight 3.00 kg

Dimensions:

- Length 708 mm
- Width 354 mm
- Height 80 mm

Short Term Compressive Strength:

- Vertical 715 kN/m$^2$
- Lateral 156 kN/m$^2$

Short Term Deflection:

Vertical 1 mm per 126 k $N/m^2$

Lateral 1 mm per 15 $kN/m^2$

Ultimate tensile strength of a single joint 42.4 $kN/m^2$

Tensile strength of a single joint at 1% secant modulus 18.8 $kN/m^2$

Bending resistance of module 0.71 kNm

Bending resistance of single joint 0.16 kNm

Volumetric void ratio 95%

Average effective perforated surface area 52%

Structural modules may be connected together to form a layer by ties, such as tie members 22 discussed earlier. Structural modules may be connected vertically by tubular shear connectors which can fit into the open ends of the support pillars in the arrangement described earlier.

Figure 7:
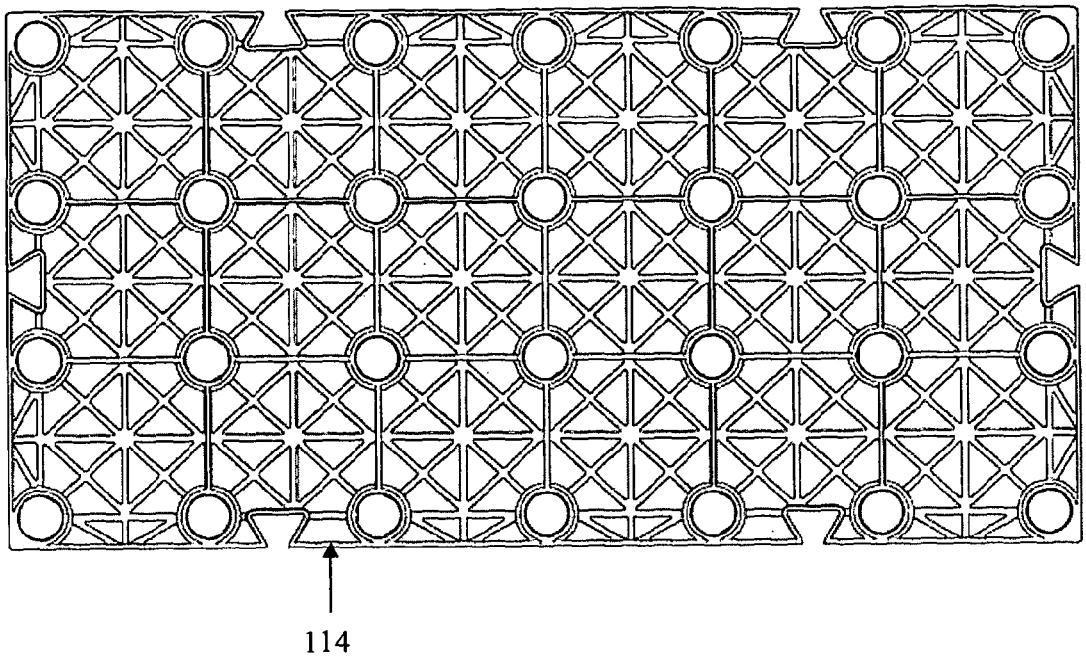
FIG. 7 is a plan view of another structural module.
Figure 8:
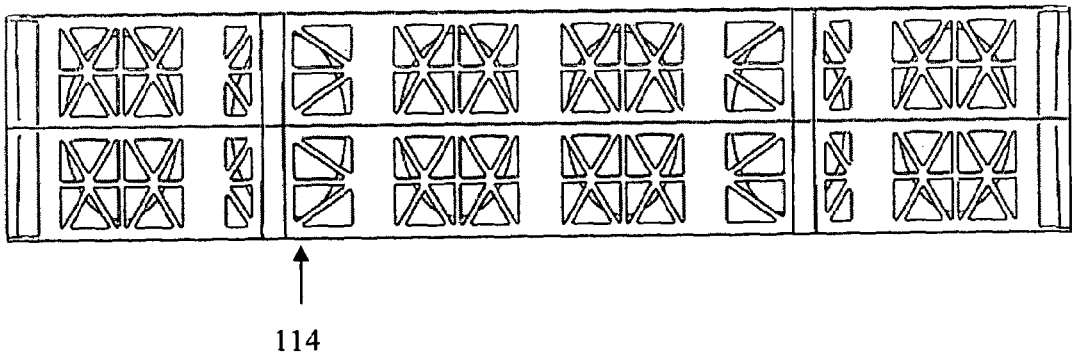
FIG. 8 is a front elevation of the structural module.
Figure 9:
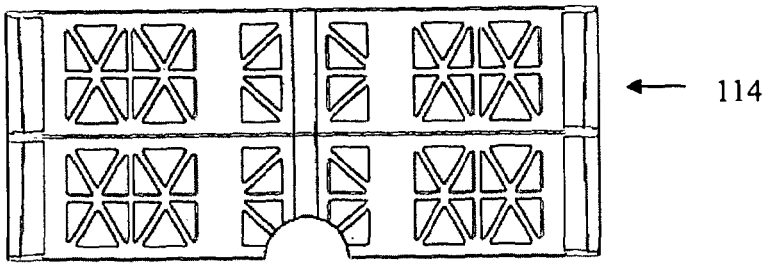
FIG. 9 is a side elevation of the structural module.
Figure 10:
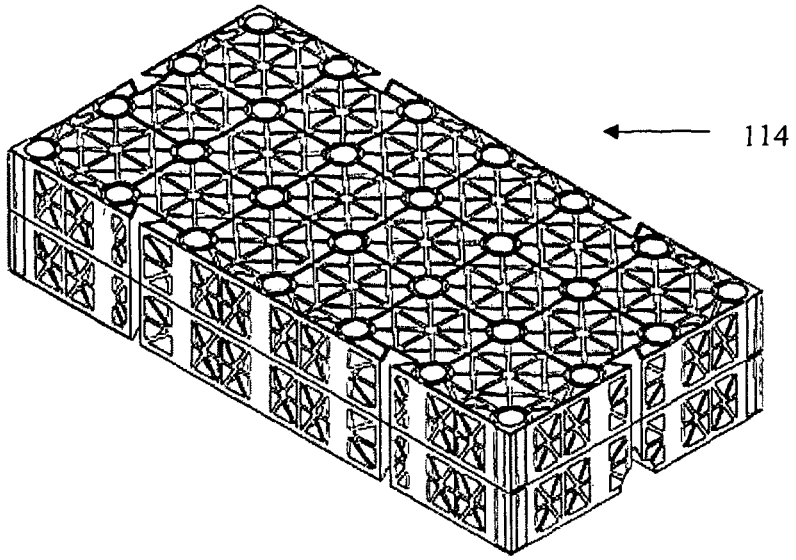
FIG. 10 is a perspective view of the structural module.

FIG. 7 is a plan view of a cuboid structural module 114, having the parameters set out above. FIG. 8 is a front elevation of the structural module, FIG. 9 is a side elevation of the structural module, and FIG. 10 is a perspective view of the structural module. As with the structural module 10 described with reference to FIGS. 1 to 6, this structural module 114 has been moulded in two halves which are then joined together.

The size and shape of each aperture in the top wall of the module 114 is as specified for the preceding embodiments.

Figure 11:
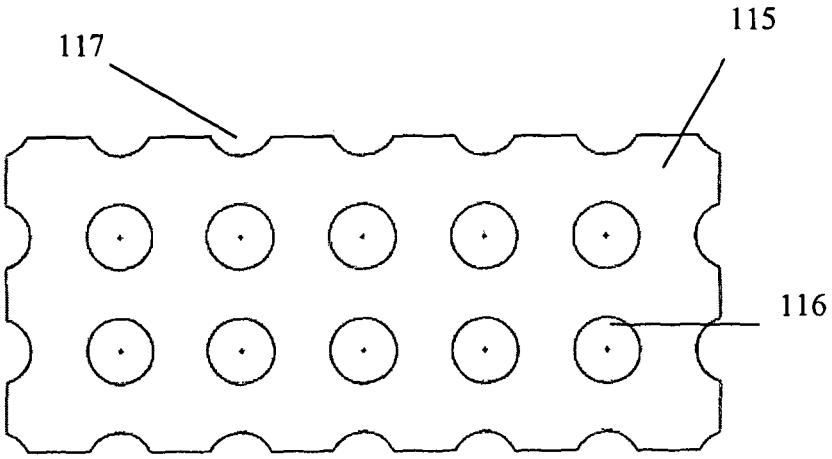
FIG. 11 is a plan view of a porous foam insert to be positioned in the structural module.

FIG. 11 is a plan view of a porous, water retentive, foamed polymeric insert 115 of OASIS™ foam to be used within the structural module 114, this having a thickness of about 75 mm so that it will occupy about one half only of the internal volume of the structural module. The interior of the structural module is provided with columns and the insert has apertures 116 and cut-outs 117 to accommodate these.

Figure 12:
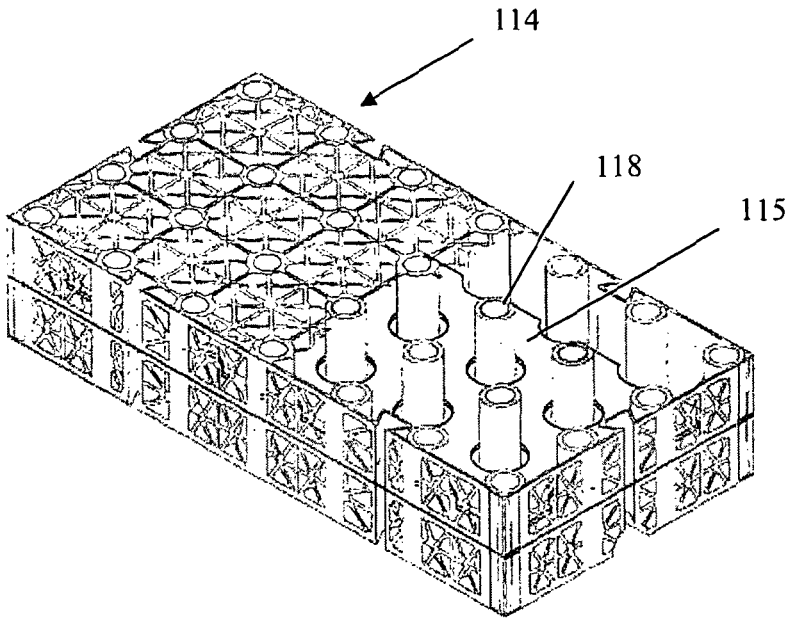
FIG. 12 is a perspective view of the structural module, partly cut away, showing the insert in place.

FIG. 12 shows the structural module 114 partly cut away, showing how the insert 115 has been positioned in the lower half of the structural module 114, with the apertures 116 and cut-outs 117 accommodating the supporting columns 118 within the structural module 114, in a manner equivalent to that discussed with reference to the structural module 10 of FIGS. 1 to 6.

In an alternative embodiment of the present invention, structural modules whose lower parts (i.e. everything apart from the top wall) are essentially as described above with reference to FIGS. 1 to 12 are used. However, in this alternative embodiment, an alternative top wall or lid is used where the apertures in the top wall have a size and shape such that the aperture causes substantially no variation in the flatness of a synthetic surface layer laid on top of the structural module.

Figure 13:
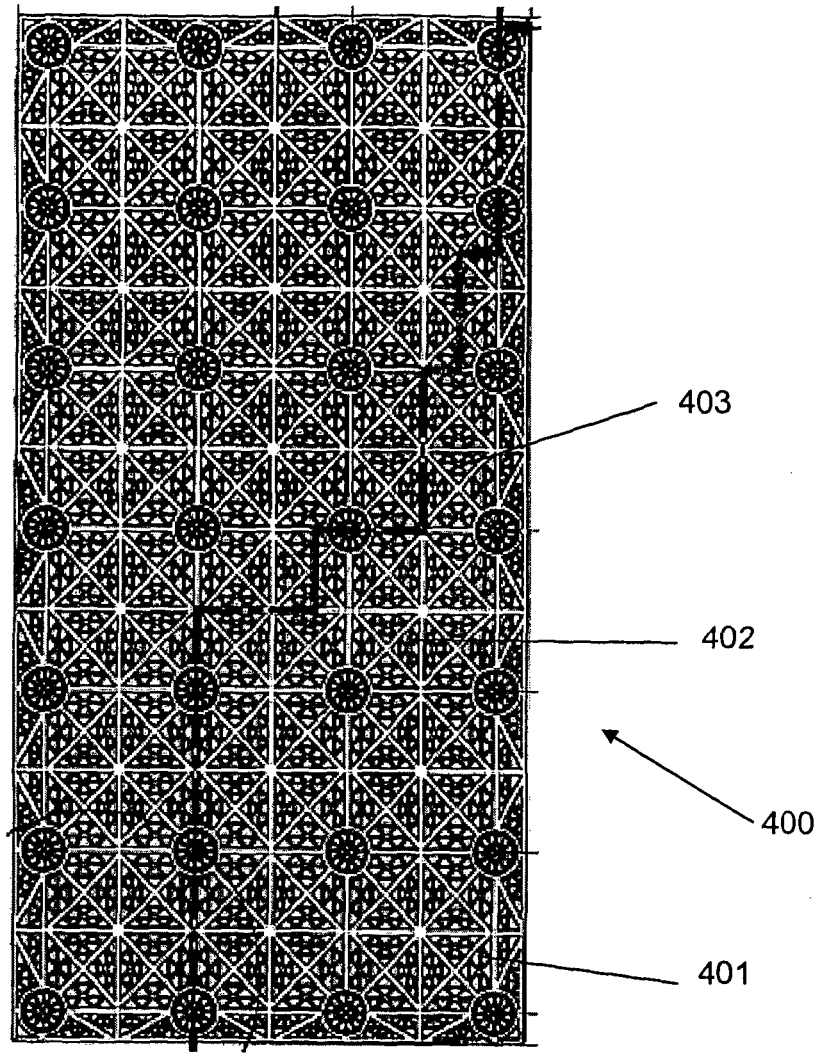
FIG. 13 is a top view of a preferred embodiment of a lid for a structural module for use in the present invention.
Figure 14:
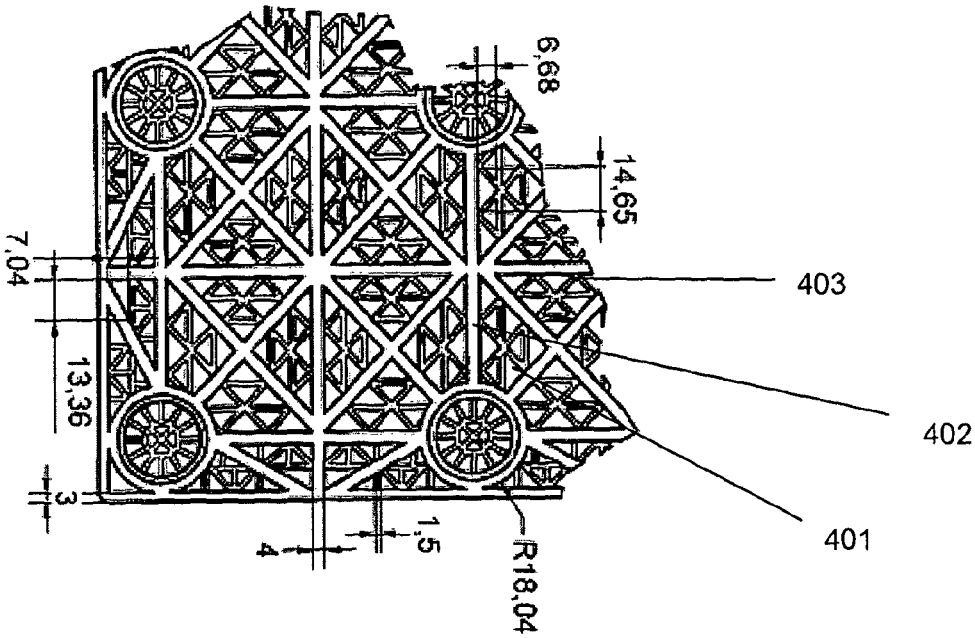
FIG. 14 is a magnified view of part of the lid shown in FIG. 13.

FIGS. 13 to 15 illustrate a lid or top wall 400 for a structural module for use in this alternative embodiment of the present invention.

The lid 400 has a plurality of apertures 401 formed from a mesh-like structure of connected members 402, 403. The members may vary in thickness, the lid 400 having a smaller number of longer thicker members 402, and a larger number of shorter thinner members 403 arranged in the spaces between the long thick members 402. The thick members 402 in particular provide additional strength to the module.

The members 402, 403 define the apertures 401 which may have various shapes such as triangles, segments of a circle or other polygons.

The size and shape of every aperture in the lid 400 is such that the aperture causes substantially no variation in the flatness of the synthetic surface layer laid on top of the structural module.

As illustrated in FIG. 15, the underside of the lid 400 has a number of elongate members 404 which can be inserted into corresponding holes or receiving portions provided in a base or lower part of the module, which could be substantially as described with reference to FIGS. 1 to 12.

Such an arrangement means that already available base parts can be used with only the lid 400 requiring modification.

FIG. 16 shows in diagrammatic form an array 405 of modules 406, which extend horizontally in both the x and y directions with their top surfaces level so as to be in the same horizontal plane. The modules may be as described with reference to any of the preceding embodiments. Placed directly on the top surfaces of the modules 406 is a flexible carpet 407. Beneath the array of modules is a geotextile layer 408, and then the underlying soil, aggregate or the like 409 on which the array is supported.

As regards the sizes and shapes of the apertures, it will be appreciated that references to a sphere means a substantially incompressible sphere. Such references could also be replaced in some instances by a reference to other objects of circular cross section. When considering particles which may be allowed to sit in an aperture without passing through, the use of a sphere to define the aperture size and shape may be considered more appropriate as a sphere of an appropriate size can sit in an aperture without passing through, whereas a cylinder cannot and will either pass through fully, or not at all.

A preferred embodiment of the invention provides a module with a lower part which forms the base and sidewalls of the module, and with supporting columns extending upwardly from the base. There is a top part which comprises a lid attached to the side walls and the columns. The lid has apertures which are dimensioned and arranged as discussed, above, so that people can walk over the module. The side walls and base have larger sized apertures. An advantage of this arrangement is that the lower part can be standard for use both in accordance with the present invention and in the known type of module. Only the top part needs to be changed. It can be a lid with the smaller apertures as in the preferred embodiment of the present invention, a lid with larger apertures, or another component which provides a top wall, part of the side walls, and part columns descending from the top wall. There is thus provided a versatile system.

The invention claimed is:

1. A structural module suitable for combining with like structural modules to form an area suitable for walking on and/or for travelling directly over by a vehicle, wherein the structural module comprises a flat top wall and a bottom wall spaced therefrom by side walls so as to define a volume between the top and bottom walls, the top wall being provided with a plurality of apertures to permit the flow of liquid into the volume, and the side walls and the bottom wall being provided with apertures to permit the flow of liquid out of the volume, wherein the size and shape of each aperture in the top wall is such that the maximum diameter of a sphere that the aperture would let through is in a range up to 10 mm, and wherein at least some of the apertures in the bottom wall and the side walls are such that they would let through a sphere with a diameter of substantially greater than 10 mm.

2. The structural module of claim 1, wherein the size and shape of each aperture in the top wall is such that the maximum diameter of sphere that the aperture would let through is 7 mm.

3. The structural module of claim 1, wherein each of the apertures in the top surface are smaller than an average size of the apertures in the side wall and each of the apertures in the top surface are smaller than an average size of the apertures in the bottom wall.

4. The structural module of claim 1, wherein there is a lower portion which provides the bottom wall and the side walls, and an upper portion in the form of a lid which is attached to the lower portion and provides the flat top wall.

5. An array of interconnected structural modules which forms an area suitable for walking on and/or for travelling directly over by a vehicle, wherein each structural module is as claimed in claim 1.

6. The array of claim 5, wherein a flexible surface layer on which a person is to walk is provided over the top walls of the modules without an intervening rigid layer.

7. The array of claim 6, wherein the size and shape of each aperture in the top wall is such that there is substantially no variation in the flatness of the flexible surface layer.

8. The structural module of claim 1, wherein the top surface is adapted to be a walking surface having apertures sized to prevent a high-heeled shoe having a heel diameter of 10 mm from passing through the top surface.

9. A method of providing a surface suitable for walking on and/or for travelling directly over by a vehicle by interconnecting in an array a plurality of structural modules, wherein each structural module comprises a flat top wall and a bottom wall spaced therefrom by side walls so as to define a volume between the top and bottom walls, the top wall being provided with a plurality of apertures to permit the flow of liquid into the volume and the side walls and the bottom wall being provided with apertures to permit the flow of liquid out of the volume, wherein the size and shape of each aperture in the top wall is such that the maximum diameter of a sphere that the aperture would let through is in a range up to 10 mm, and wherein at least some of the apertures in the bottom wall and the side walls are such that they would let through a sphere with a diameter of substantially greater than 10 mm.

10. The method of claim 9, wherein the size and shape of each aperture in the top wall is such that the maximum diameter of a sphere that the aperture would let through is 7 mm.

11. The method of claim 9, wherein a flexible surface layer on which a person is to walk is provided over the top walls of the modules without an intervening rigid layer.

12. The method of claim 11, wherein the size and shape of each aperture in the top wall is such that there is substantially no variation in the flatness of the flexible surface layer.

13. The method of claim 9, wherein at least some of the apertures in the side walls and/or the bottom wall are such that they would let through a sphere with a diameter of substantially greater than 10 mm.

14. The method of claim 9, wherein there is a lower portion which provides the bottom wall and the side walls, and an upper portion in the form of a lid which is attached to the lower portion and provides the flat top wall.

15. An array of interconnected structural modules which forms an area suitable for walking on and/or for travelling directly over by a vehicle, wherein each structural module comprises a flat top wall and a bottom wall spaced therefrom by side walls so as to define a volume between the top and bottom walls, the top wall being provided with a plurality of apertures to permit the flow of liquid into the volume and the side walls and the bottom wall being provided with apertures to permit the flow of liquid out of the volume, wherein a flexible surface layer on which a person is to walk is provided over the top walls of the modules without an intervening rigid layer, and wherein the size and shape of each aperture in the top wall is such that there is substantially no variation in the flatness of the flexible surface layer, and wherein at least some of the apertures in the bottom wall and the side walls are such that they would let through a sphere with a diameter of substantially greater than 10 mm.

16. The array of claim 15, wherein the size and shape of each aperture in the top wall is such that the maximum diameter of a sphere that the aperture would let through is in a range up to 10 mm.

17. The array of claim 16, wherein the size and shape of each aperture in the top wall is such that the maximum diameter of sphere that the aperture would let through is 7 mm.

18. The array of claim 15, wherein at least some of the apertures in the side walls and/or the bottom wall are such that they would let through a sphere with a diameter of substantially greater than 10 mm.

19. The array of claim 15, wherein each module has a lower portion which provides the bottom wall and the side walls, and an upper portion in the form of a lid which is attached to the lower portion and provides the flat top wall.

20. A method of providing a surface suitable for walking on and/or for travelling directly over by a vehicle by interconnecting in an array a plurality of structural modules, wherein each structural module comprises a flat top wall and a bottom wall spaced therefrom by side walls so as to define a volume between the top and bottom walls, the top wall being provided with a plurality of apertures to permit the flow of liquid into the volume and the side walls and the bottom wall being provided with apertures to permit the flow of liquid out of the volume, wherein a flexible surface layer on which a person is to walk is provided over the top walls of the modules without an intervening rigid layer, and wherein the size and shape of each aperture in the top wall is such that there is substantially no variation in the flatness of the flexible surface layer, and wherein at least some of the apertures in the bottom wall and the side walls are such that they would let through a sphere with a diameter of substantially greater than 10 mm.

21. The method of claim 20, wherein the size and shape of each aperture in the top wall is such that the maximum diameter of a sphere that the aperture would let through is in a range up to 10 mm.

22. The method of claim 20, wherein the size and shape of each aperture in the top wall is such that the maximum diameter of sphere that the aperture would let through is 7 mm.

23. The method of claim 20, wherein at least some of the apertures in the side walls and/or the bottom wall are such that they would let through a sphere with a diameter of substantially greater than 10 mm.

24. The method of claim 20, wherein each module has a lower portion which provides the bottom wall and the side walls, and an upper portion in the form of a lid which is attached to the lower portion and provides the flat top wall.

* * * * *